US010648630B2

(12) United States Patent
Dicken et al.

(10) Patent No.: US 10,648,630 B2
(45) Date of Patent: May 12, 2020

(54) LUMINAIRE FOR UNIFORM ILLUMINATION

(71) Applicant: OSRAM GmbH, Munich (DE)

(72) Inventors: Norbert Dicken, Aachen (DE); Marc Rosenboom, Fuerth (DE); Tobias Pfaffenbauer, Munich (DE)

(73) Assignee: OSRAM GMBH, Munich (DE)

( * ) Notice: Subject to any disclaimer, the term of this patent is extended or adjusted under 35 U.S.C. 154(b) by 0 days.

(21) Appl. No.: 16/082,981

(22) PCT Filed: Feb. 14, 2017

(86) PCT No.: PCT/EP2017/053204

§ 371 (c)(1),
(2) Date: Sep. 7, 2018

(87) PCT Pub. No.: WO2017/153129

PCT Pub. Date: Sep. 14, 2017

(65) Prior Publication Data

US 2019/0093837 A1 Mar. 28, 2019

(30) Foreign Application Priority Data

Mar. 9, 2016 (DE) ..... 10 2016 203 810

(51) Int. Cl.
*F21S 8/00* (2006.01)
*F21V 23/00* (2015.01)
(Continued)

(52) U.S. Cl.
CPC ..... *F21S 8/033* (2013.01); *F21S 8/043* (2013.01); *F21V 19/0015* (2013.01);
(Continued)

(58) Field of Classification Search
None
See application file for complete search history.

(56) References Cited

U.S. PATENT DOCUMENTS 4,200,900 A 4/1980 McGeorge
6,695,629 B1 2/2004 Mayer
(Continued)

FOREIGN PATENT DOCUMENTS

CN 201251064 Y 6/2009
CN 201836778 U 5/2011
(Continued)

OTHER PUBLICATIONS

International Search Report based on application No. PCT/EP2017/053204 (6 pages + 2 pages of English Translation) dated May 17, 2017 (for reference purpose only).
(Continued)

*Primary Examiner* — Ashok Patel
(74) *Attorney, Agent, or Firm* — Viering, Jentschura & Partner MBB

(57) ABSTRACT

A luminaire, comprising: a luminaire rear wall for mounting to a wall or ceiling, a printed circuit board, fitted with a plurality of light-emitting diodes and having a connecting cable, as a light-emitting means, and a connecting clamp connected to the connecting cable and to which a supply cable is able to be clamped. A spacer is fixedly mounted to the luminaire rear wall, to which the printed circuit board is releasably attached, with a free space being formed between the printed circuit board and the luminaire rear wall. The whole connecting cable, or a majority thereof, and the connecting clamp are arranged in the free space.

11 Claims, 3 Drawing Sheets

(51) Int. Cl.

| | |
|---|---|
| ***F21V 19/00*** | (2006.01) |
| ***F21S 8/04*** | (2006.01) |
| ***F21V 21/03*** | (2006.01) |
| ***F21Y 115/10*** | (2016.01) |
| *F21Y 101/00* | (2016.01) |
| *F21Y 105/10* | (2016.01) |

(52) U.S. Cl.

CPC ..... *F21V 19/0035* (2013.01); *F21V 21/03* (2013.01); *F21V 23/002* (2013.01); *F21V 23/009* (2013.01); *F21S 8/04* (2013.01); *F21V 19/004* (2013.01); *F21Y 2101/00* (2013.01); *F21Y 2105/10* (2016.08); *F21Y 2115/10* (2016.08)

(56) References Cited

U.S. PATENT DOCUMENTS

| | | | | |
|---|---|---|---|---|
| 10,012,375 | B1 * | 7/2018 | Salessi | F21V 29/503 |
| 2011/0188233 | A1 * | 8/2011 | Josefowicz | F21S 8/086 362/158 |
| 2015/0139755 | A1 | 5/2015 | Lu et al. | |

FOREIGN PATENT DOCUMENTS

| | | | |
|---|---|---|---|
| JP | 200455800 | A | 2/2004 |
| JP | 201196416 | A | 5/2011 |
| JP | 201269359 | A | 4/2012 |
| WO | 2013128733 | A1 | 9/2013 |
| WO | 2014079138 | A1 | 5/2014 |

OTHER PUBLICATIONS

German Search Report based on application No. 10 2016 203 810.9 (8 pages) dated Dec. 6, 2016 (for reference purpose only).

* cited by examiner

LUMINAIRE FOR UNIFORM ILLUMINATION

CROSS-REFERENCE TO RELATED APPLICATION

The present application is a national stage entry according to 35 U.S.C. § 371 of PCT application No.: PCT/EP2017/053204 filed on Feb. 14, 2017, which claims priority from German Patent Application Serial No.: 10 2016 203 810.9 which was filed Mar. 9, 2016, and is incorporated herein by reference in its entirety and for all purposes.

TECHNICAL FIELD

The present disclosure relates to a luminaire having a luminaire rear wall for mounting to a wall or ceiling, a printed circuit board, fitted with a plurality of light-emitting diodes and having a connecting cable, as a light-emitting means, and a connecting clamp, which is connected to the connecting cable and to which a supply cable is able to be clamped.

BACKGROUND

Luminaires are expected to provide uniform lighting. This is desirable not only for the lighting of the respective surfaces, but also for the overall appearance of the luminaire.

This desire for uniform lighting in particular also relates to LED wall luminaires or LED ceiling luminaires. A problem with respect to any shadowing is the connection wiring which is frequently guided via the LEDs in the light path. This produces undesired shadows and artifacts for example on the luminaire cover.

In the case of typical LED luminaires, the connecting lines coming out of the wall and the lines that come from the light-emitting means are placed next to the light-emitting means so as to produce as little shadowing as possible. However, this negatively impacts the size of the light-emitting means and the shape of the luminaire. In addition, it is also not possible thereby to exclude that the connecting lines are imaged on the luminaire covers.

In practice, one solution which has also found widespread use is the placement of a separate ballast between the wall connecting line and the light-emitting means. The ballast requires space and either results in shadows on the luminaire cover or in dark spots due to a lack of lighting since the LEDs must be placed around the ballast. The consequence is a lower luminance in the region of the ballast, manifesting for example as a dark zone on the luminaire cover.

SUMMARY

As a result, it is the object of the present description to describe a luminaire, the light-emitting means of which has a plurality of LEDs, or light-emitting diodes, and the lighting of which is as homogeneous as possible.

Accordingly, a luminaire having a luminaire rear wall for mounting to a wall or ceiling is provided. The luminaire rear wall is thus prepared for mechanical attachment to a wall, a ceiling or another carrier and has, for example, corresponding holes. Moreover, the luminaire rear wall may have a cutout through which supply lines, as a non-limiting example, from a 230 V supply network, may be guided. Moreover, the luminaire has a printed circuit board, fitted with a plurality of light-emitting diodes and having a connecting cable. The light-emitting diodes on such a printed circuit board are typically distributed uniformly so as to achieve homogeneous lighting. The energy supply of the printed circuit board, which with its light-emitting diodes serves as the light-emitting means, is effected via the connecting cable, which is connected to the supply cable during mounting. A supply or connecting cable of this type typically has two or three cores. For distribution purposes, it is also possible for a plurality of supply cables to be connected to the connecting cable. The connection of the connecting cable to the supply cable, or to the supply cables, may be realized by way of a connecting clamp of the luminaire. The connecting clamp used may be for example a clamp by WAGO.

In addition to these customary components, the LED luminaire is equipped with a spacer which is fixedly mounted to the luminaire rear wall and to which the printed circuit board is releasably attached, with a free space being formed between the printed circuit board and the luminaire rear wall. The printed circuit board is consequently not attached directly to the luminaire rear wall; rather, one or more spacers ensure that a given distance between the printed circuit board and the luminaire rear wall is produced which defines the free space. The free space may also offer the advantage that air may circulate behind the printed circuit board and correspondingly cool the latter. In addition, the whole connecting cable or a majority thereof and the connecting clamp are advantageously arranged in the free space. That means that it is at most the connecting region of or an insignificant part of the overall length of the connecting cable that extends on the side of the printed circuit board on which the light-emitting diodes are arranged. The main part, or the entire free part, of the connecting cable extends on the rear side of the printed circuit board that is remote from the light-emitting diodes, that is to say in the free space between the printed circuit board and the luminaire rear wall. For this reason, neither the connecting cable nor the connecting clamp may cause shadowing of the light-emitting diodes. Overall, this therefore produces a more homogeneous lighting of any luminaire cover that may be provided or of the illuminated surface.

A ballast may be integrated in the printed circuit board. The ballast may here form a closed unit, or individual components of the ballast are distributed over the printed circuit board just like the light-emitting diodes themselves. In the latter case, it is thus possible for light-emitting diodes to be placed between the components, with the result that the region of the ballast does not have to be dark either.

It may furthermore be advantageous if a ballast of the light-emitting means is arranged in a dedicated housing in the free space between the printed circuit board and the luminaire rear wall. In this non-limiting embodiment variant, standard ballasts may be used, for non-limiting example, as a result of which for example the production costs of the luminaire may be reduced.

In this variant, in which the ballast is arranged in a dedicated housing between the printed circuit board and the luminaire rear wall, or luminaire rear plate, it is possible for the ballast itself, or the housing thereof, to be embodied as the spacer, or the ballast and the spacer together define a distance between the printed circuit board and the luminaire rear wall. The ballast or the housing may even be the only spacer between the luminaire rear wall and the printed circuit board. In this way, the ballast has the additional function of being a spacer, making it possible to further reduce the mounting complexity.

The spacer and the printed circuit board may furthermore be fastened to one another by way of a releasable snap-fit connection. This has the advantage that the printed circuit board merely needs to be pressed onto the spacer to fasten it here by way of the snap-fit connection. For demounting purposes, the snap-fit connection may be released with or without tools.

In a non-limiting embodiment, the spacer may have a locking hook and the printed circuit board may have a cutout, with the locking hook being releasably hooked in the cutout. The arrangement of the connection elements may of course also be provided in inverse fashion. In this case, the printed circuit board would be equipped with a locking hook, while the spacer would have a corresponding cutout. In these different manners, it is relatively simple to realize a snap-fit connection.

In a non-limiting embodiment, the spacer has a cylindrical main body, which is fixedly connected to the luminaire rear wall by way of a first end side. For example, the main body may be adhesively bonded or screw-connected to the luminaire rear wall. The cylindrical main body may furthermore also merely be plugged onto the luminaire rear wall, however, and be held here by way of a non-releasable snap-fit connection. The cylindrical shape is here understood to mean any general cylinder, including not only a circular cylinder, but also a prism or a cuboid, as a non-limiting example.

In a non-limiting embodiment, the locking hook has a pin-type first portion, which perpendicularly projects from a second end side of the cylindrical main body that is located opposite the first end side, and a pin-type second portion is integrally molded on the distal end of the first portion at an acute angle relative thereto. In addition, a third portion is integrally molded on the distal end of the second portion at an obtuse angle. This special type of locking hook permits purely perpendicular mounting and demounting of the printed circuit board to and from the luminaire rear wall. This may be advantageous when mounting to walls and ceilings. This produces the snap-fit connection in particular because the first pin-type portion of the locking hook is connected in a resilient fashion to the second portion of the locking hook. An advantageous property may also be found in the connection between the second portion and the third portion of the locking hook. Such a locking hook may be produced, as a non-limiting example, as an injection-molded part. A suitable plastics material should be used here, which guarantees the resilient properties. The locking hook is possibly even embodied in one piece with the main body of the spacer and in particular molded in one piece.

In accordance with an alternative non-limiting embodiment, the printed circuit board is attached to the spacer by way of a bayonet connecting element. A corresponding bayonet connection represents a reliable attachment which may be effected quickly and may be released just as quickly.

According to a further advantageous non-limiting embodiment, the printed circuit board is attached to the luminaire rear wall only by the spacer or a plurality of such spacers. That means that no further mounting elements other than the spacers themselves, or the connecting elements which are integrally molded thereto, are necessary to retain the printed circuit board on the luminaire rear wall. In particular, the edge of the printed circuit board is then also not supported for example on the luminaire rear wall in any way. This lack of further attachment elements likewise brings about a more cost-effective production, simplified mounting and improved air circulation between the printed circuit board and the luminaire rear wall.

BRIEF DESCRIPTION OF THE DRAWINGS

In the drawings, like reference characters generally refer to the same parts throughout the different views. The drawings are not necessarily to scale, emphasis instead generally being placed upon illustrating the principles of the invention. In the following description, various aspects are described with reference to the following drawings, in which.

DETAILED DESCRIPTION

The non-limiting embodiments which will be explained in more detail below represent preferred embodiments of the present invention. It should be noted in this respect that the individual features may be implemented not only in the feature combinations stated here, but also alone or in other, technically meaningful combinations.

According to a non-limiting embodiment, it may be ensured that the light-emitting means, in the present case a printed circuit board with light-emitting diodes, is produced such that the shape thereof is adapted to the luminaire in order to obtain lighting which is as homogeneous and shadow-free as possible. To make this possible, cables are disposed on the side of the wall and on the side of the luminaire such that neither shadows nor dark zones are caused.

Figure 1:
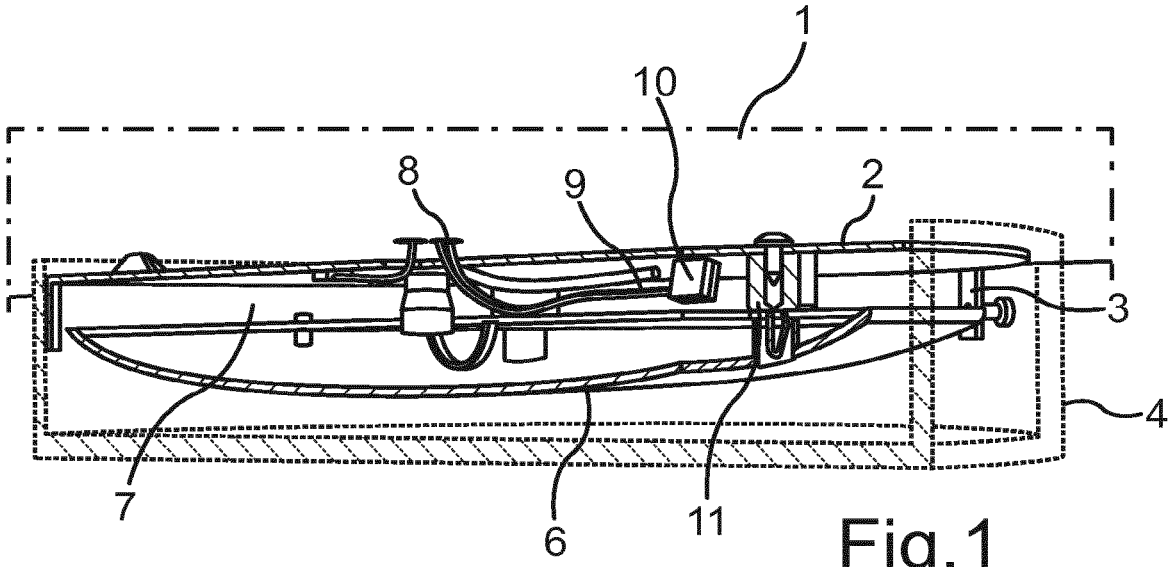
FIG. 1 shows a cross section of a luminaire according to an embodiment.
Figure 2:
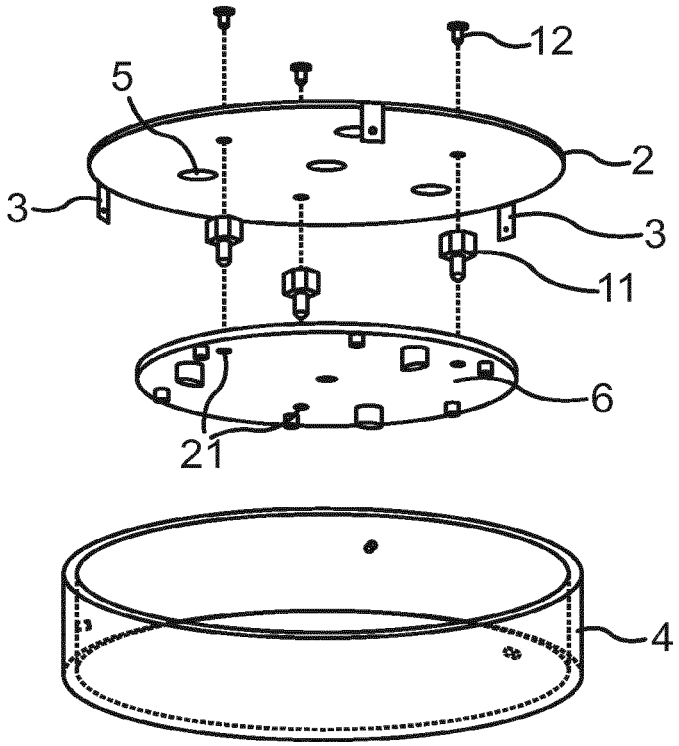
FIG. 2 shows an exploded illustration of a luminaire according to the description.

In the non-limiting example of FIG. 1, a luminaire is mounted to a ceiling 1. A luminaire of this type may also however be mounted to a wall or another type of carrier. The luminaire has a luminaire rear wall 2, by which it may be attached to the ceiling 1 or the other carrier. This attachment may be effected, as a non-limiting example, using screws and dowels. The luminaire rear wall 2 may have the shape of a panel, but also, as a non-limiting example, the shape of a plate. In one non-limiting implementation, the luminaire rear wall 2 has the shape of a circle. However, it may also be oval, rectangular or have another shape. In addition, the luminaire rear wall 2 may have one or more retaining elements, e.g. tabs 3, with which a luminaire cover 4 may be attached to the luminaire rear wall 2. As may be more clearly seen in the exploded drawing of FIG. 2, the luminaire cover 4 may include a transparent ring, for example. FIG. 2 furthermore shows that the luminaire rear wall 2 has, as a non-limiting example, a plurality of holes 5, by way of which it may be mounted to the ceiling, to the wall or the like.

Figure 3:
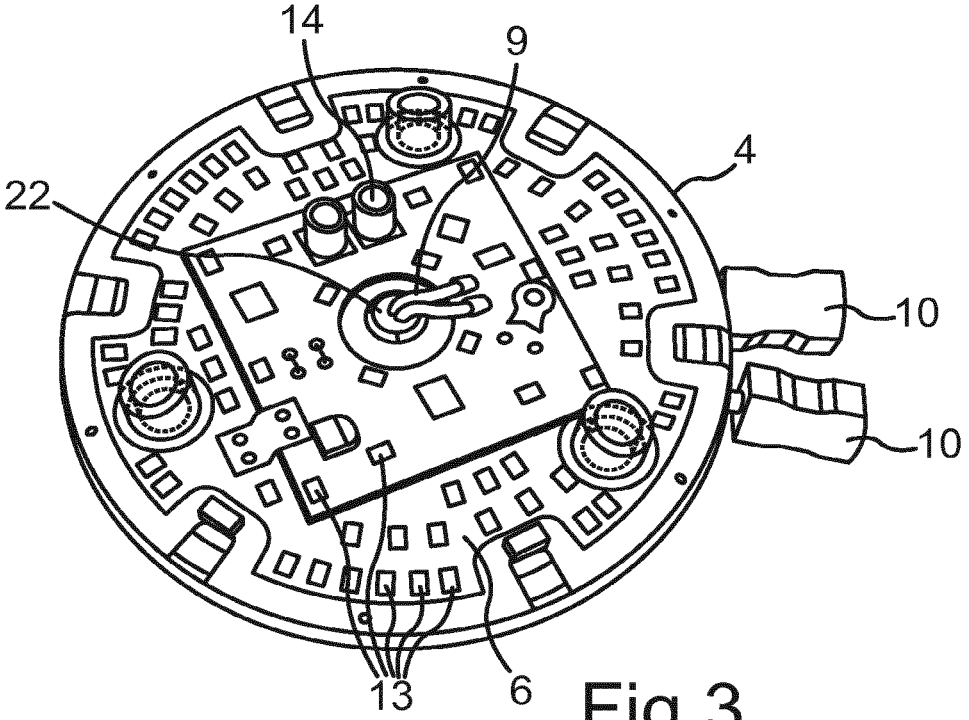
FIG. 3 shows a front side view of a printed circuit board for a luminaire with a luminaire cover.

The luminaire has, as the light-emitting means, a printed circuit board 6 having light-emitting diodes (cf. FIG. 3). In the present non-limiting example, this printed circuit board has a round form. However, it may also have a different geometric shape. Moreover, the printed circuit board 6 in the present example is curved in the manner of a plate. This should also be considered to be no more than an example. The printed circuit board 6 may alternatively be purely planar, as a non-limiting example. To form focusing light radiation, the printed circuit board 6 may also take the form of a concave mirror.

The light-emitting means, that is to say the printed circuit board 6 with light-emitting diodes, is mounted at a distance from the luminaire rear wall 2. This produces a free space 7 between the luminaire rear wall 2 and the printed circuit board 6. Disposed in this free space are wall-side or ceiling-side supply lines, which together form a supply cable 8, and light-emitting means-side connecting lines, which together form a connecting cable 9, and connecting plugs or connecting clamps 10.

The number of connecting clamps may be one, two, three or more. A connecting clamp by WAGO may be used, as a non-limiting example. By disposing the entire connecting cable 9, or the majority thereof, and the one or more connecting clamps 10 in the free space 7, they are not within the light path of the light-emitting diodes of the printed circuit board 6. In the example of FIG. 1, the light path extends downward, starting from the printed circuit board 6, and the connecting cable 9 and the connecting clamp 10 are situated substantially above the printed circuit board 6. Due to the fact that the connecting elements are no longer situated in the light path, they do not produce any shadows on any luminaire cover or on the surfaces to be illuminated.

The light-emitting means, or the printed circuit board 6 with the light-emitting diodes, is positioned in the luminaire by way of spacers 11 in a manner such that the necessary distance, and consequently the free space 7, is produced. The distance should be at least 10 mm, in order that one or more connecting clamps 10 may be easily positioned in the free space 7. In a non-limiting example, the distance kept is 12 mm. This distance is sufficient for NYM-3×1.5 mm wiring (supply cable 8), the light-emitting means connecting lines (connecting cable 9) and a plurality of connecting clamps 10 (e.g. WAGO 224-101).

The spacer or spacers 11 are attached on the side of the luminaire rear wall 2 which faces the printed circuit board 6. This may be effected, as a non-limiting example, by way of screws 12, as is indicated in FIG. 2. Alternatively, the spacers 11 may also be adhesively bonded to the luminaire rear wall or be plugged in, for example by way of a non-releasable snap-fit connection.

FIG. 3 shows an embodiment of a luminaire according to the invention without a luminaire rear wall in the front view, i.e. from the light-emitting side. The luminaire in this case has a transparent, bowl-type luminaire cover 4. The circular printed circuit board 6 may be seen behind it. Arranged on the printed circuit board 6 are numerous light-emitting diodes 13. As far as possible, the light-emitting diodes 13 are uniformly distributed over the surface of the printed circuit board 6, such that a uniform luminance is obtained. The connecting cable 9 with two lines may be seen at the center of the printed circuit board. A strain relief 22 protects the solder joints of the connecting cable 9 against excess tensile strain.

Figure 4:
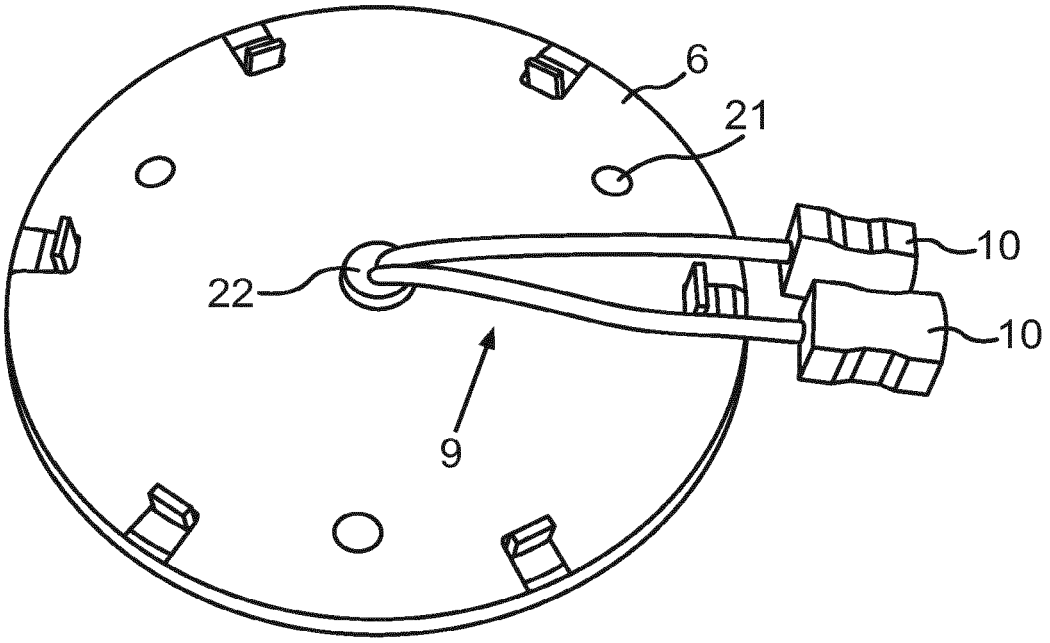
FIG. 4 shows a rear side view of the printed circuit board of FIG. 3.

FIG. 4 shows the rear side of the printed circuit board 6 of FIG. 3. The connecting cable 9 with its two lines (e.g. for the conductors L and N of the wall wiring) protrudes from the center. Located at the end of the lines of the connecting cable 9 are insulated connecting plugs or connecting clamps 10. The strain relief 22 at the bushing in the printed circuit board 6 for the connecting cable 9 may also be seen in the present example from the rear side of the printed circuit board 6.

The connecting cable 9 is not limited to including exactly two lines. Rather, the connecting cable 9 may also include one, three or more cables. What is important however is that the largest part of the connecting cable 9 is located on the rear side of the printed circuit board 6. Only an insignificant part of the connecting cable 9 is located in the present example on the front side, which is shown in FIG. 3. The cable bushing of the printed circuit board 6 is thus located in the direct vicinity of the connecting locations to which the connecting cable 9 is clamped or soldered. Due to the fact that the cable 9 is guided through to the rear side of the printed circuit board 6 immediately next to the connecting locations, in the present example more than 90 percent of the connecting cable 9 is located on the rear side. The length of the connecting cable 9, or of each connecting line, is preferably not greater than the average distance of the light-emitting diodes in the region of the connecting locations of the printed circuit board 6.

The LED luminaire typically also has a ballast. The ballast is either integrated on the printed circuit board or is accommodated in a separate housing and mounted in the free space 7 between the printed circuit board 6 and the luminaire rear wall 2. In the example of FIG. 3, the ballast is integrated on the printed circuit board 6. The printed circuit board 6 has corresponding components 14. The dimensions of these components 14 of the ballast, however, are so small that they practically cause no shadows. They also do not project beyond light-emitting diodes 13 of the printed circuit board 6.

For the case that a ballast with a separate housing is used, the housing may also be used as the spacer for the printed circuit board 6 with respect to the luminaire rear wall 2. It is possible for additional spacers 11 to be used.

In the non-limiting example of FIG. 2, three spacers 11 are used. This is sufficient without redundancy. The number of the spacers 11, however, may also be less than or more than three. The spacers should be embodied such that the light-emitting means, specifically the printed circuit board 6, may be pulled out of the luminaire before mounting and replaced on the luminaire rear wall 2 after mounting of the luminaire rear wall 2 and the connecting lines 9. The spacers should thus provide for the user an easily detachable connection between the luminaire rear wall 2 and the printed circuit board 6. It is hereby possible to create at the same time a complete freedom of form of the light-emitting means and ensure optimum lighting.

A further variant is that the printed circuit board 6 is held on the luminaire rear wall 2 by way of a hinge and the printed circuit board 6 is locked for example at a spacer. The hinge or the hinges may have the same or a similar distance that is also produced by the spacers between the printed circuit board and the luminaire rear wall.

Figure 5:
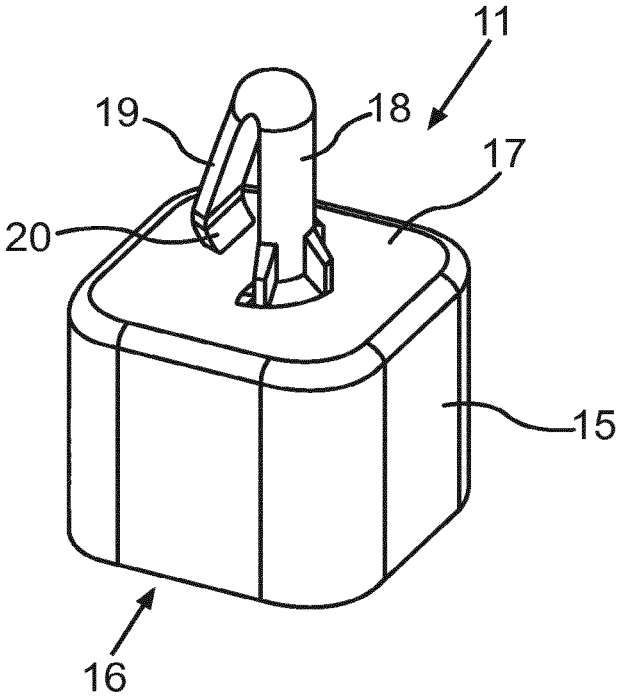
FIG. 5 shows a spacer for a luminaire according to the description.

FIG. 5 shows a concrete embodiment of a spacer 11. This spacer 11 has a cuboid or cylindrical main body 15. In the present example, this is a cuboid or quadrilateral cylinder having rounded edges, a first end side 16 and a second end side 17 located opposite the former. A first pin-type portion 18 projects from the second end side 17. The pin-type portion may have, as a non-limiting example, a length which is of the order of magnitude of the height of the main body 15. In the state when it is mounted to the luminaire rear wall 2, this first portion 18 is perpendicular to the luminaire rear wall 2. At the distal end of the first portion 18, a second portion 19 is integrally molded thereto at an acute angle. Again integrally molded at the distal end of the second portion 19, which is likewise of a pin-type embodiment, is a third portion 20 at an obtuse angle. The three portions 18, 19 and 20 form a locking hook. The first portion 18 and the second portion 19 are elastically interconnected with the result that the acute angle between them may be reduced by pressing on the second portion 19. As a result, a snap-fit connection may be realized, for example by pressing the locking hook into a cutout 21 (cf. FIGS. 2 and 4). The third portion 20 of the locking hook ensures that the snap-fit connection is releasable without destruction.

The locking hook 11 may be injection-molded for example from a plastics material. It is particularly advantageous if it is injection-molded in one piece. With respect to the material selection, the flexibility between the first portion 18 and the second portion 19 of the locking hook should be taken into account.

In the luminaire, a spacer may be advantageously provided, which is used to produce a cavity between the luminaire rear wall 2 and the light-emitting means, or the printed circuit board. It is possible hereby to lay connecting lines in a manner such that no shadow becomes visible on any luminaire cover which may be present. A releasable connection between supply cable 8 and connecting cable 9 should be provided by way of one or more connecting clamps. It is possible, hereby, to separate the light-emitting means from the luminaire rear wall 2 and thus for the luminaire rear wall 2 to be fixedly screw-connected without obstruction to the ceiling or another carrier. Subsequently, both cable ends may be simply connected. In summary, this produces the advantage that the light-emitting means is easily removable from the ceiling-mounted luminaire without the light image being restricted.

While specific aspects have been described, it should be understood by those skilled in the art that various changes in form and detail may be made therein without departing from the spirit and scope of the aspects of this disclosure as defined by the appended claims. The scope is thus indicated by the appended claims and all changes which come within the meaning and range of equivalency of the claims are therefore intended to be embraced.

LIST OF REFERENCE SIGNS

1 Ceiling
2 Luminaire rear wall
3 Tab
4 Luminaire cover
5 Hole
6 Printed circuit board
7 Free space
8 Supply cable
9 Connecting cable
10 Connecting clamp
11 Spacer
12 Screw
13 Light-emitting diode
14 Component
15 Main body
16 First end side
17 Second end side
18 First portion
19 Second portion
20 Third portion
21 Cutout
22 Strain relief

The invention claimed is:

1. A luminaire, comprising:
a luminaire rear wall configured to be directly mounted to a wall or a ceiling;
a printed circuit board fitted with a plurality of light-emitting diodes and
having a connecting cable; and
a connecting clamp connected to the connecting cable;
a supply cable clamped to the connecting cable;
a spacer fixedly mounted to the luminaire rear wall, wherein the printed circuit board is releasably attached to the spacer;
a free space between the printed circuit board and the luminaire rear wall; wherein
at least a majority of the connecting cable and the connecting clamp are arranged in the free space.

2. The luminaire as claimed in claim 1, wherein a ballast is integrated in the printed circuit board.

3. The luminaire as claimed in claim 1, further comprising a ballast of the light-emitting means is arranged in a dedicated housing in the free space between the printed circuit board and the luminaire rear wall.

4. The luminaire as claimed in claim 3, wherein the ballast is the spacer.

5. The luminaire as claimed in claim 1, wherein the spacer and the printed circuit board are attached to one another by way of a releasable snap-fit connection.

6. The luminaire as claimed in claim 5, wherein the spacer has a locking hook and the printed circuit board has a cutout, with the locking hook being releasably hooked in the cutout.

7. The luminaire as claimed in claim 6, wherein the spacer has a cylindrical main body, which is fixedly connected to the luminaire rear wall by way of a first end side.

8. The luminaire as claimed in claim 7, wherein the locking hook has a pin-type first portion, which perpendicularly projects from a second end side of the cylindrical main body located opposite the first end side, a pin-type second portion is integrally molded on the distal end of the first portion at an acute angle relative thereto, and integrally molded at the distal end of the second portion is a third portion at an obtuse angle.

9. The luminaire as claimed in of claim 1, wherein the printed circuit board is attached to the spacer by way of a bayonet connecting element.

10. The luminaire as claimed in claim 1, wherein the printed circuit board is attached to the luminaire rear wall only by way of the spacer or by way of a plurality of such spacers.

11. The luminaire as claimed in claim 3, wherein the ballast, together with the spacer, define a distance between the printed circuit board and the luminaire rear wall.

* * * * *